US006621489B2

(12) United States Patent
Yanagisawa et al.

(10) Patent No.: US 6,621,489 B2
(45) Date of Patent: Sep. 16, 2003

(54) LCD DISPLAY UNIT

(75) Inventors: Tetsuya Yanagisawa, Iwaki (JP); Tsuyoshi Kondo, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 175 days.

(21) Appl. No.: 09/777,552

(22) Filed: Feb. 5, 2001

(65) Prior Publication Data

US 2001/0020928 A1 Sep. 13, 2001

(30) Foreign Application Priority Data

Mar. 3, 2000 (JP) ..... 2000-059688

(51) Int. Cl.[7] ..... G09G 5/00
(52) U.S. Cl. ..... 345/211; 345/87
(58) Field of Search ..... 345/87–102, 211–215; 713/300–340

(56) References Cited

U.S. PATENT DOCUMENTS 5,627,569 A * 5/1997 Matsuzaki et al. ..... 345/211
6,081,902 A 6/2000 Cho
6,219,016 B1 * 4/2001 Lee ..... 345/211

FOREIGN PATENT DOCUMENTS

EP 0 881 622 A1 * 12/1998 ..... G09G/3/36
JP 03-296713 * 12/1991 ..... G02F/1/133
JP 11-271707 * 10/1999 ..... G02F/1/133

* cited by examiner

*Primary Examiner*—Richard Hjerpe
*Assistant Examiner*—Alexander Eisen
(74) *Attorney, Agent, or Firm*—Brinks Hofer Gilson & Lione

(57) ABSTRACT

In the reflex type LCD display unit, there occur blurry irregular after-images on the display screen especially when the power is turned off, which detracts from the perception of quality of the LCD display. The LCD display unit of the invention incorporates a power operation timing controller that controls the power supply to the elements of the LCD display unit and the video signal output at specific timings. When the power is turned off, the power operation timing controller makes a video setting unit switch a video switch so as to select a black image display signal to display a black image on the screen. Next, the power operation timing controller causes a hold circuit to hold this black image display signal through a video-fixing signal output unit; causes a gate voltage control unit to turn off the gate voltage; after a specific time, causes a common electrode control unit to turn common electrodes off; and further after a specific time, causes a source voltage control unit to turn off the source voltage and the supply voltage to the hold circuit. When the power is turned on, after a specific time after the LCD power being turned on, the power operation timing controller permits the hold circuit to output the video signal that has been held by the hold circuit.

17 Claims, 6 Drawing Sheets

POWER-ON ACTUATION TIMING

POWER-OFF ACTUATION TIMING

LCD DISPLAY UNIT

BACKGROUND OF THE INVENTION

1. Field of the Invention

The present invention relates to an LCD display unit capable of preventing turbulence of images, generated when the image on the LCD display is switched or the LCD power supply is turned off, and more specifically to an LCD display unit that prevents the turbulence of images in the reflex LCD.

2. Related Art

In replacement of the cathode-ray tube that has been used in various types of information display units, the Liquid Crystal Display (hereunder, referred to as "LCD") has widely been employed, because it has advantages of requiring less space for installation and less power consumption. The LCD has various types. From the standpoint of structure, there is the direct-view type in which a user views the display itself directly, and the projection type in which a user views images projected on a screen. The widely used direct-view type LCD includes the transmission type LCD having a backlight, and the reflex type LCD utilizing the reflected light of natural light and/or a room lamp light. Since it is impossible to present visible images without a surrounding light source, the reflex type LCD includes a type provided with a backlight, so that backlighting can be used as needed.

Because the liquid crystal substance does not emit spontaneously, the transmission type LCD is provided with a backlight on the backside of an array substrate, which irradiates a light thereon. While the light permeates through the array substrate containing the liquid crystal substance and the liquid crystal cells, the liquid crystal produces a torsion effect on the light, whereby the transmission type LCD gives a viewer images obtained by the light transmitting through a polarization plate. In contrast to this, the reflex type LCD makes natural light being irradiated on the surface of the liquid crystal cell substrate reflect on the array substrate and the liquid crystal cell substrate to thereby give a viewer images.

Further, the LCD uses the Nematic liquid crystal substance as represented by the TN type, STN type, DSTN type, etc., which includes the passive matrix LCD as a simple matrix system using passive elements only, not using active elements, and the active matrix LCD inside of which the drive control is carried out by the active elements such as the thin film transistors and diodes represented by the TFT type LCD. In recent years, there have been strong demands for a fine color image with a good response on a wide display such as a personal computer display and a TV display, etc., so that the active matrix LCD has been adopted increasingly.

Such an active matrix LCD will be explained with a representative TFT type LCD as an example, with reference to FIG. 5. Thin film transistors (hereunder, abbreviated as TFT) as the active elements are connected to the intersections of the longitudinal pixel electrodes X and the lateral pixel electrodes Y. One end of each TFT is supplied with a data signal and the other end thereof is connected to a storage capacitor (not illustrated) and the pixels formed by the liquid crystal substance are inserted in parallel with the storage capacitors. Further, the gate electrodes are connected to the lateral pixel electrodes Y, to which address signals are supplied from the outside, and in accordance with the address signals, the data signals are transmitted to the pixels through the TFTs.

The active matrix LCD of the TFT type formed on the foregoing principle is driven and controlled by a drive circuit as shown in FIG. 6, for example. This drive circuit is composed of, to classify broadly, a signal control circuit 32, power supply circuit 34, gradation voltage circuit 33, facing electrode drive circuit 35, address line drive circuit 36 as a gate driver, data line drive circuit 37 as a source driver, and the like, which drives a liquid crystal panel 31 having a structure as shown in FIG. 5. The drive circuit including these control circuits forms a liquid crystal module 30.

In such a drive circuit, as a power supply voltage, clock signals $\phi$1, $\phi$2, a synchronizing signal, and a data signal are supplied, the signal control circuit 32 supplies the data line drive circuit 37 as the source driver with the data signal, the control signal, and the clock signal $\phi$1, and supplies the address line drive circuit 36 as the gate driver with the control signal, clock signal $\phi$2. The power supply circuit 34 regulates the power supply supplied from the outside, and supplies a necessary power supply voltage to a driver IC of the data line drive circuit 37 and a driver IC of the address line drive circuit 36. The gradation voltage circuit 33 supplies the data line drive circuit 37 with a gradation voltage used by the data driver for generating an output voltage. Further, the facing electrode drive circuit 35 supplies a common voltage to common electrodes facing the pixel electrodes.

In the TFT type LCD, a gate voltage from the address line drive circuit 36 turns the TFT on/off by row, and during the on interval of the TFT, the output voltage from the data line drive circuit 37 enters a source electrode 45 of a TFT 44 through a data line 43. Through a drain electrode 46, the output voltage is applied across a pixel electrode, which is illustrated by a capacitor 50 of the pixel portion represented by way of the equivalent circuit in the drawing, and a storage capacitor 51 that holds the supplied voltage, which is connected in parallel with the pixel electrode, whereby an image is displayed. Here, the difference between the potential of the pixel electrode and the potential of the facing electrode is the voltage applied to the liquid crystal layer, and this applied voltage presents a liquid crystal image with an appropriate gradation.

After the gate of the TFT is switched off thereafter, the voltage stored across the storage capacitor 51 maintains the displayed image as it is. In order to present the next frame image, the gate voltage is again supplied to the TFT to turn it on, and the reverse voltage to the former is supplied to the pixel and the storage capacitor. Thereby, the charges across the pixel and the charges across the storage capacitor are discharged, and next a specific reverse voltage for presenting an image of a specific gradation is stored across the storage capacitor 51 to present a next frame image. To repeat such operations presents a specific image on the whole display. Here, in FIG. 6, the storage capacitor 51 is connected to a Cs line 42 provided separately from the common electrode 41, however it can be connected to the common electrode 41 without using the Cs line 42.

In the LCD display unit that carries out the foregoing operations, to finish the liquid crystal display from the state of a normal liquid crystal display, all the power supply lines are brought into the off state. Consequently, the power supply line leading to the power supply circuit 34 is switched off, and the data signal line is switched off at the same time. Since the TFT is brought into the off state at that time, the storage capacitor 51 that stores a charge so as to continuously maintain a specific voltage for maintaining the image on each pixel will continue to maintain the state with the charge held. However, the charges are discharged gradually from leakage elements such as an internal resistance of the TFT 44 and the like, which causes uncertain turbulence of the liquid crystal in the pixel portions of the entire display, depending on characteristics such as the discharge characteristics of the elements and the characteristics of the elements that are influenced by the internal and external circuits. Here, in the reflex type LCD, for a period of time after turning off the power, the disturbed images can be seen through the uncertain turbulence of the liquid crystal, which presents blurry, irregular after-images.

With respect to this point, the backlight type LCD that has widely been used is provided with a backlight on the backside of the array substrate that irradiates a light, whereby a user is to view images obtained by the light passing through the liquid crystal. Therefore, turning off the power supply of the LCD will simultaneously turn off the backlight to suppress the transmission of light through the liquid crystal almost completely. Accordingly, there cannot be seen such irregular after-images created in the liquid crystal as the in foregoing phenomenon.

Further, in the backlight type LCD, in order to execute the video muting that temporarily erases images during display, it is not necessary to turn off the power supply, because to turn off the backlight makes almost invisible the state of a normal display image processed in the liquid crystal. Therefore, the video muting in the backlight type LCD has been carried out by turning off the backlight.

On the other hand, the reflex type LCD with recent advancements in research and development, which is being widely employed, makes natural light falling on the surface of the liquid crystal cell substrate reflect on the array substrate and the liquid crystal cell substrate to present an image. Therefore, the phenomenon of the turbulence of the liquid crystal, which is created when the power supply is turned off, is viewed as irregular after-images by reflected light, which detracts from the perception of quality of the display and the equipment that incorporates the display, and gives an unacceptable feeling to a user.

Further, since it is not provided with a backlight as the backlight type LCD has, the reflex type LCD is not able to execute the video muting by the foregoing technique. Accordingly, unless a special measure is taken, a temporal muting of video images requires turningoff the power supply, which gives a user the irregular after-images at each time of the video muting.

Incidentally, in the reflex type LCD, to eliminate the necessity of turning off the power supply at each time of the video muting, it is possible to give an appearance as the video images are muted, in which the video signal input circuit prepares the normal video signal input and the black image signal input so that they can be switched alternately, and when the video mute signal is inputted, the circuit is switched into the black image signal input to display the black image on the LCD display unit.

SUMMARY OF THE INVENTION

The present invention has been made in view of the foregoing circumstances, and it is a major object of the invention to provide an LCD display unit that does not produce irregular after-images on the LCD display when the power supply thereof is shut off, even in the reflex type LCD.

According to one aspect of the invention, the LCD display unit displays video images by reflected light for the most part, and includes: a video setting unit that sets either a normal video signal or a specific image display signal as a video signal for image display; a gate voltage control unit that controls a gate voltage of drive elements of pixels; a common electrode control unit that controls common electrodes of the pixels; a source voltage control unit that controls a supply voltage to a data line drive circuit; and a power operation timing controller that controls operation timings of the units when the power supply is turned on/off. In addition to the above construction, the power operation timing controller includes a means that, after the video setting unit sets the specific image display signal when the power supply is turned off, the gate voltage control unit turns off the gate voltage, the common electrode control unit turns the common electrodes off, and then the source voltage control unit turns off the supply voltage to the data line drive circuit.

According to another aspect of the invention, in the LCD display unit, the time at which the common electrodes are turned off is set to the time after an image display by the specific image display signal is maintained for a specific time.

According to another aspect of the invention, in the LCD display unit, a point of time at which the supply voltage to the data line drive circuit is turned off is set to the time at which a common electrode voltage is substantially dissipated.

According to another aspect of the invention, in the LCD display unit, when the power supply is turned on, the power operation timing controller turns on the source voltage control unit, the gate voltage control unit, and the common electrode control unit, and thereafter outputs the video signal to the data line drive circuit.

BRIEF DESCRIPTION OF THE DRAWINGS

FIG. 4(*b*) is an operation timing chart for the power-off operation;

DETAILED DESCRIPTION OF THE PREFERRED EMBODIMENT

Figure 1:
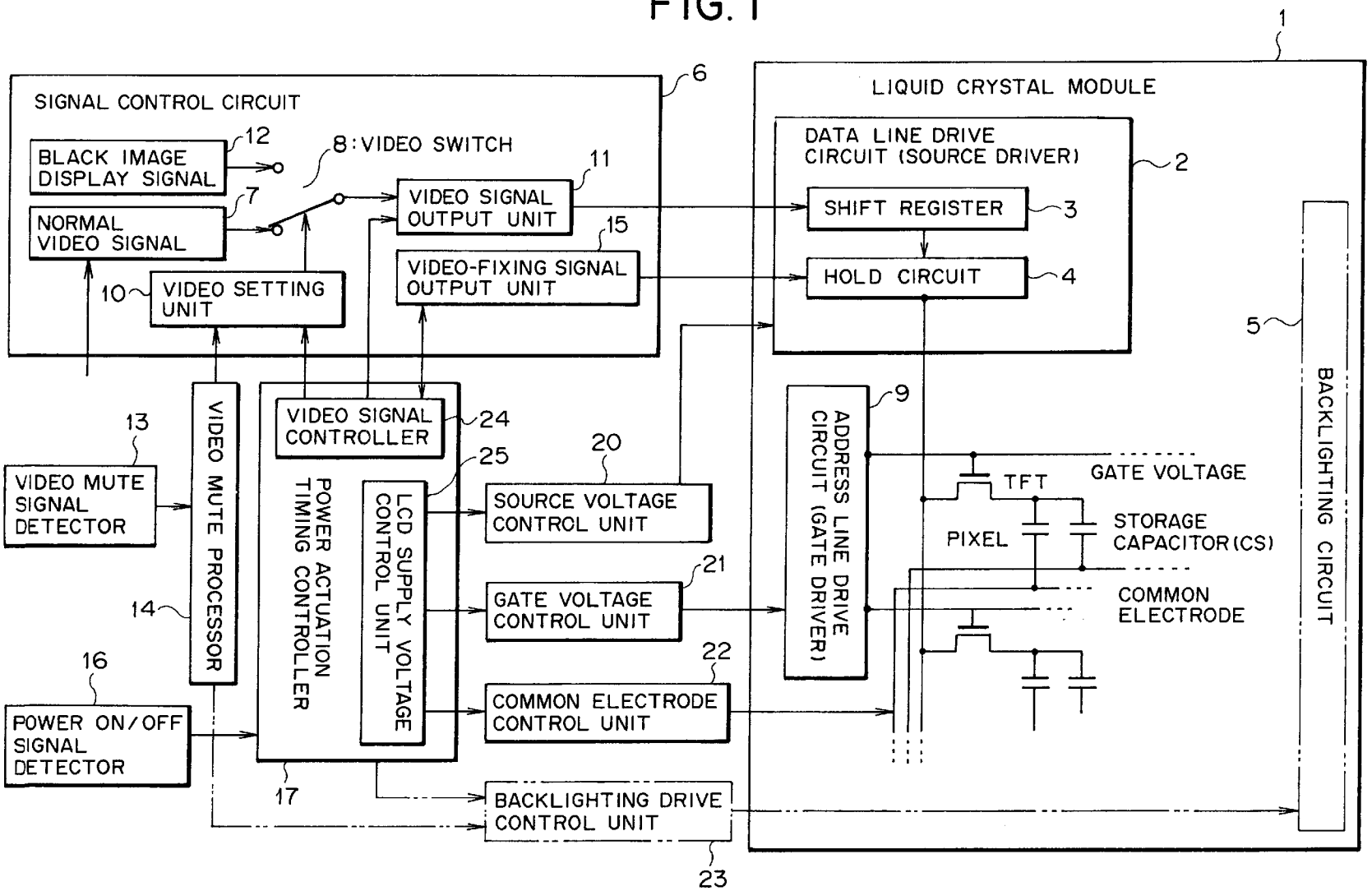
FIG. 1 is a functional block diagram of one embodiment according to the invention.
Figure 6:
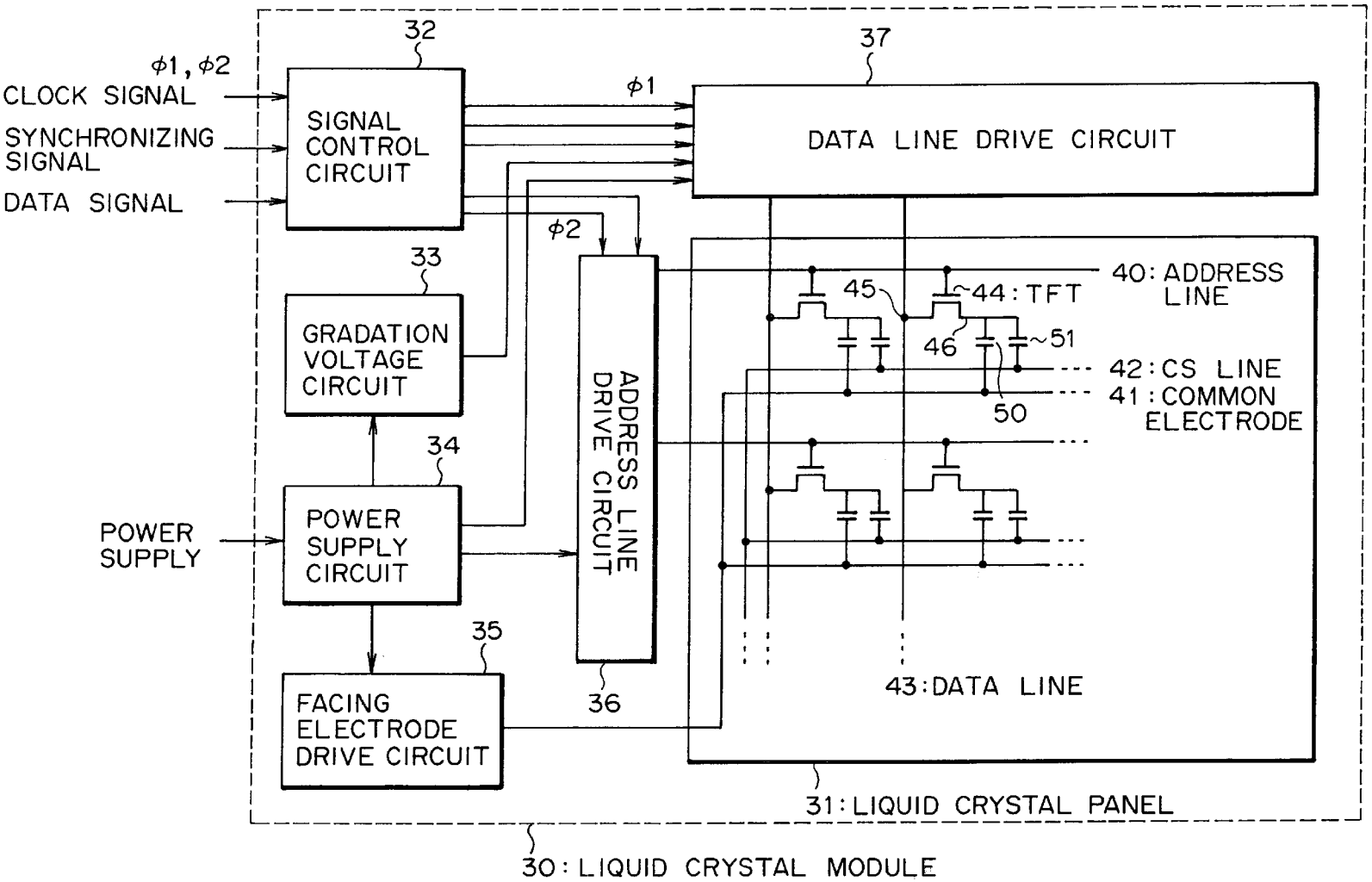
FIG. 6 is a functional block diagram of a conventional LCD display unit.

A preferred embodiment of the invention will be described with reference to the accompanying drawings. FIG. 1 is a functional block diagram of one embodiment, which illustrates the power on/off system as a major part. A liquid crystal module 1 in FIG. 1 has the same configuration as the conventional one shown in FIG. 6, and has the same function. However, in the liquid crystal module of the LCD display unit of the embodiment shown in FIG. 1, a data line drive circuit 2 as the source driver contains a hold circuit 4 that can hold a signal from a shift register 3. Further, this LCD display unit is a reflex type LCD, but it may include a backlighting circuit 5 as needed, which is shown by the chain double-dashed line in the drawing.

To the data line drive circuit 2 is connected a signal control circuit 6, and in the signal control circuit 6 during the normal LCD display, a normal video signal 7 is inputted to a video switch 8 from the outside. Normally, this video switch 8 is set by a video setting unit 10 to the position shown in the drawing, whereby the normal video signal 7 is outputted from a video signal output unit 11 to the shift register 3 of the data line drive circuit 2 in the conventional manner.

The video switch 8 is designed to switch the video signal input from the normal video signal 7 or a black image display signal 12. In the video muting that temporarily erases the image of the LCD display, as a video mute signal detector 13 detects a video mute signal by a muting switch operation or the like, the video setting unit 10 receiving the video mute signal through a video mute processor 14 makes the video switch 8 switch the input signal to the black image display signal 12 from the normal video signal 7. Consequently, the black image display signal 12 is inputted from the video signal output unit 11 to the shift register 3 of the data line drive circuit 2, which makes all the pixels present a black color to thereby create a state of the image being temporarily erased.

The signal control circuit 6 is further provided with a video-fixing signal output unit 15, and when a signal during the power being turned off is inputted to the video-fixing signal output unit 15 from a video signal controller 24 of a power operation timing controller 17 described later, the video-fixing signal output unit 15 is designed to output the signal to the hold circuit 4 of the data line drive circuit 2 at a specific timing. Further, the video signal controller 24 is enabled to output a control signal to the video signal output unit 11, which makes it possible to permit or prohibit the output of the video signal to synchronize the timing with the functional portions during the power being turned on/off.

Further, the power operation timing controller 17 outputs a signal to the video setting unit 10 as well, and when a signal during the power being turned off is inputted, the power operation timing controller 17 switches, as the first processing, the video switch 8 to the black image display signal 12 in the same manner as the foregoing video mute processing, to thereby output the black image display signal 12 from the video signal outputting unit 11. Here, the power operation timing controller 17 may output the signal to the video mute processor 14 instead of outputting it to the video setting unit 10, to thereby output the black image display signal 12 from the video signal output unit 11, as in the video mute processing.

As the detailed operation is described later, an LCD supply voltage control unit 25 of the power operation timing controller 17 outputs an operation timing signal to a source voltage control unit 20 to control the power supply to the data line drive circuit 2. It also outputs the operation timing signal to a gate voltage control unit 21 to execute the control of the power supply to the address line drive circuit 9, namely, the supply/cutting-off of the gate voltage at a specific timing. Further, it outputs the operation timing signal to a common electrode control unit 22 as well, to execute the control of the common electrode line, namely, the power on/off control at a specific timing to a portion that controls a voltage facing to a signal voltage of the pixel.

The foregoing control units and the like can be controlled by the control circuits separately provided in the LCD display unit, or the LCD display unit may incorporate the control circuits. Further, when the LCD display unit includes the backlighting circuit 5, a backlighting drive control unit 23 is provided to control the drive of the backlighting circuit 5 by a signal from the power operation timing controller 17. If the backlighting circuit 5 is being provided in this manner, the backlighting drive control unit 23 controls the lighting-out and lighting of the backlight by a signal from the video mute processor 14 in video muting.

Figure 2:
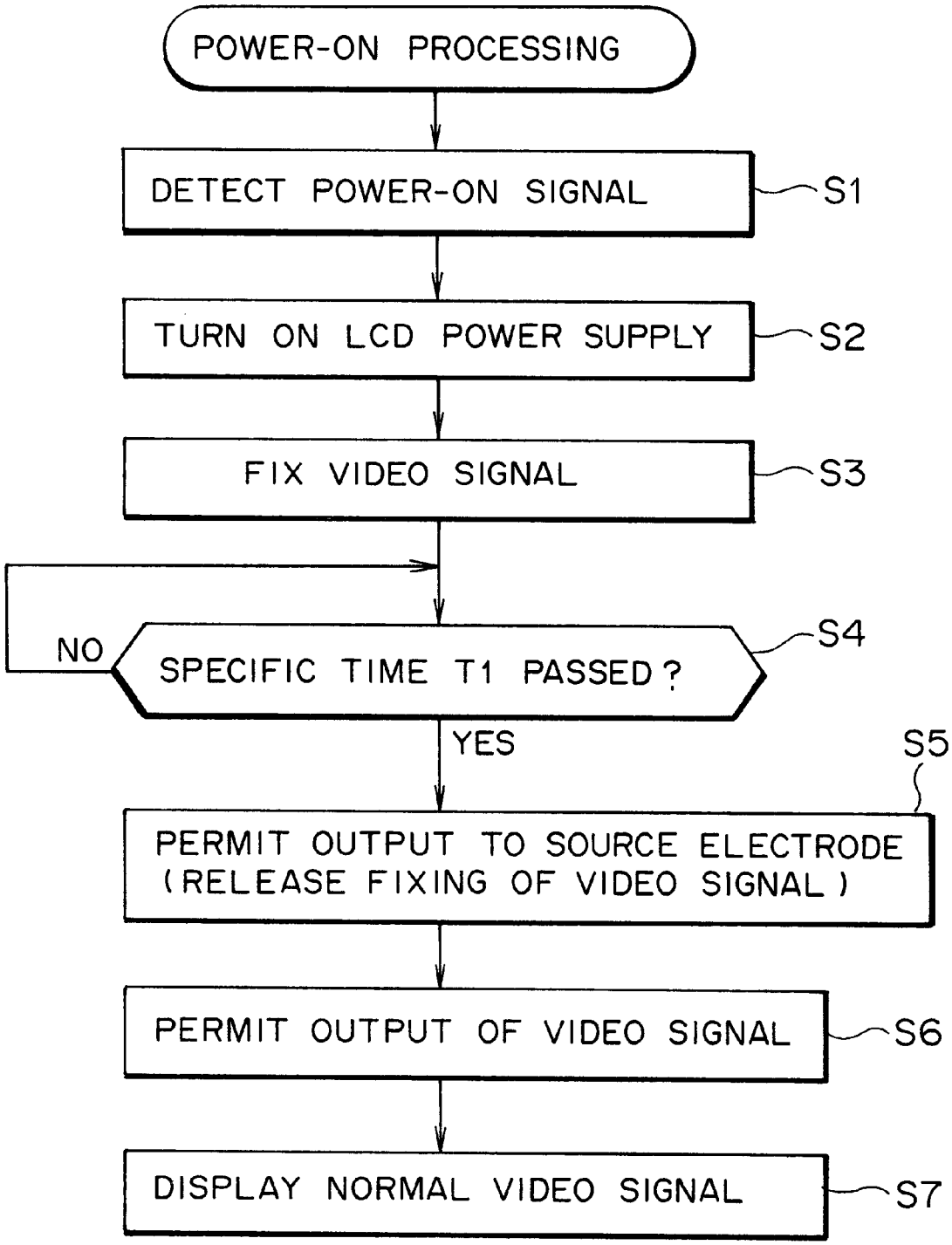
FIG. 2 is a flow chart of the power-on processing in one embodiment according to the invention.
Figure 3:
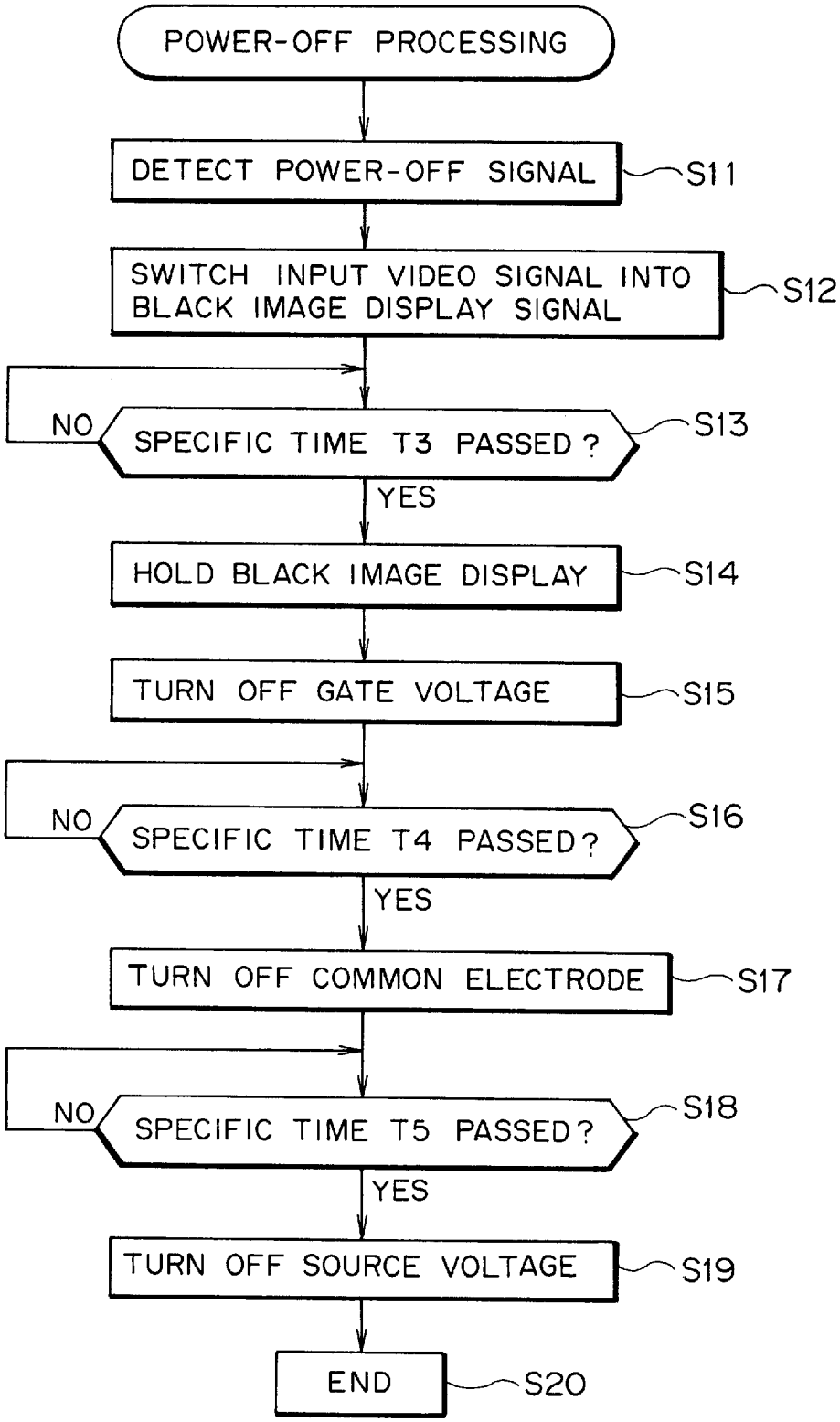
FIG. 3 is a flow chart of the power-off processing in one embodiment of the invention.

In the LCD display unit thus constructed, a series of operations is carried out during the power being turned on according to the operation flow illustrated in FIG. 2, and during the power being turned off according to the operation flow illustrated in FIG. 3. These operations will now be described with reference to the functional block diagram shown in FIG. 1 and the power-on/power-off operation timing charts shown in FIG. 4.

Figure 4A:
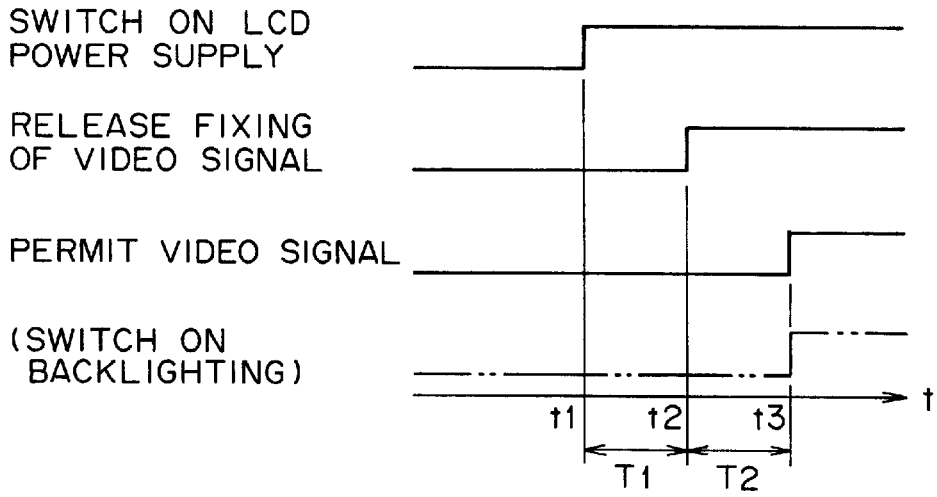
FIG. 4(*a*) is an operation timing chart for the power-on operation.
Figure 4B:
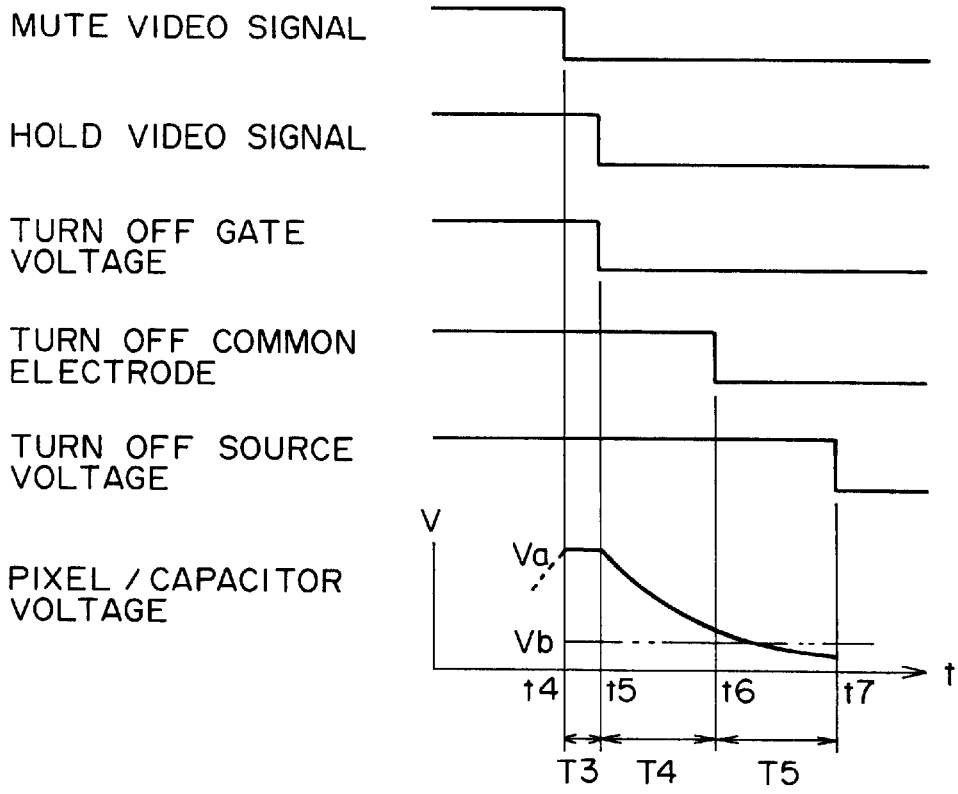
Figure 5A:
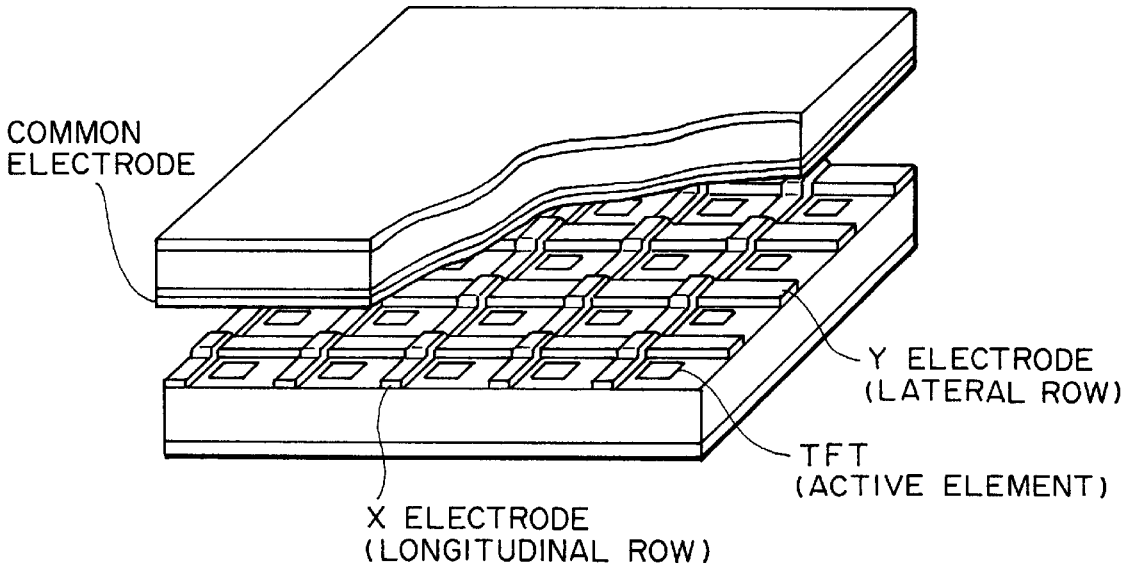
FIG. 5 is an enlarged view of a pixel portion of an LCD display unit to which the present invention is applied, in which FIG. 5(*a*) is a perspective view illustrating the structure thereof, and FIG. 5(*b*) is a perspective view illustrating the circuit configuration thereof.
Figure 5B:
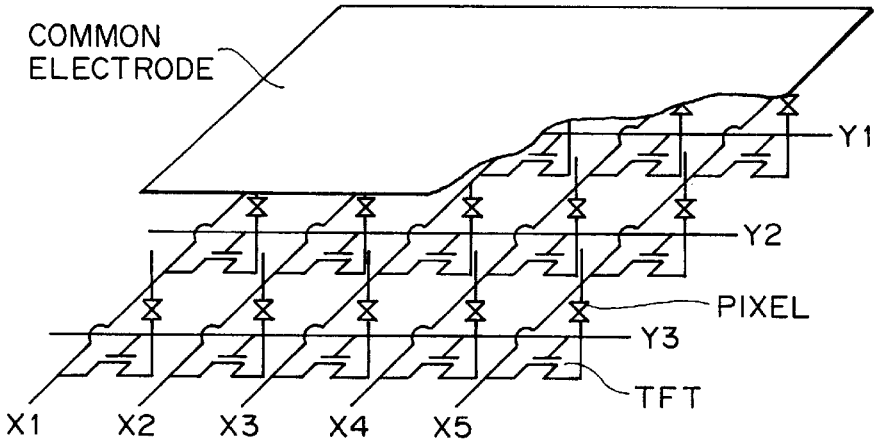

The power-on operations are carried out according to the processing flow shown in FIG. 2, and are operated sequentially according to the timing shown in FIG. 4(*a*). That is, a power on/off signal detector 16 in FIG. 1 detects an output signal from a power switch or the like that a user operates (step S1), and the LCD supply voltage control unit 25 of the power operation timing controller 17 executes the power-on control of the LCD power supply based on the detected signal (step S2). Here, the LCD supply voltage control unit 25 outputs the power-on signal to the source voltage control unit 20 connected to the LCD supply voltage control unit 25, the gate voltage control unit 21, and the common electrode control unit 22, in which the power-on processing is carried out. As the result, the elements inside the liquid crystal module 1 are brought into an operation start enable state. This state is illustrated by the rise of the LCD power supply at the first point of time t1, in the power-on operation timing chart in FIG. 4(*a*).

Thereafter, at the same time with the operation at step S2, the video signal controller 24 of the power operation timing controller 17 confirms the operation state in the video-fixing signal output unit 15. If it does not maintain the video-fixing operation state in the previous operation, the video signal controller 24 outputs the signal to the video-fixing signal output unit 15, and makes the video-fixing signal output unit 15 instruct the fixing of the video signal to the hold circuit 4 (step S3). This prohibits the output of the video signal to the pixels, and supplies the various signals to the pixels during the unstable operation state until the LCD power supply rises, which prevents the unstable images from being produced on the display. Here, in the video-fixing signal output unit 15, when the video-fixing operation is executed during the previous operation and the state is maintained as it is, it is only needed to continue the state.

Next, the power operation timing controller 17 waits for a specific time T1 required for the rise of the liquid crystal pixels and the like inside the liquid crystal module 1 (step S4). After the time period T1 passes, the video-fixing signal output unit 15 releases the hold signal outputted to the hold circuit 4, and permits the output of the video signal from the data line drive circuit 2 (step S5). This state is illustrated by the release of the video signal fixing at the second point of time t2 after time period T1 passes from the first point of time t1, in FIG. 4(*a*).

After the hold of the video signal is released in the hold circuit 4, the video signal controller 24 outputs the control signal to the video signal output unit 11, and enables the shift register 3 of the data line drive circuit 2 to output the video signal (step S6). During the power being turned on, the video switch 8 is brought to the normal state illustrated in FIG. 1, whereby the normal video signal 7 from the outside is outputted to the shift register 3, and the shift register 3 outputs the video signal to each of the pixels of the liquid crystal module 1 being turned into a signal input standby state by the power supply turned on previously, thus executing the normal video signal display (step S7).

This state is illustrated by the permission of the video signal at the third point of time t3 after a specific time period T2 passes from the second point of time t2, in FIG. 4(*a*). Here, the permission of the video signal may be carried out at any time after the hold is released to the hold circuit 4, or it may be done at the same time. When the LCD display unit is provided with the backlighting circuit 5, the power operation timing controller 17 outputs to the backlighting drive control unit 23 an operation-starting signal at the same time with the permission of the video signal, and executes the lighting of the backlight at the timing shown in FIG. 4(*a*).

On the other hand, the power-off operations are carried out according to the processing flow shown in FIG. 3, and are operated sequentially according to the timing shown in FIG. 4(*b*). That is, the power on/off signal detector 16 detects a power-off signal from the power switch or the like that the user operates (step S11). On the basis of the detected signal, the video signal controller 24 of the power operation timing controller 17 outputs to the video setting unit 10 a switch operation signal for the video switch 8 to switch from the normal video signal 7 to the black image display signal 12 and output the black image display signal 12 to the video signal output unit 11 (step S12). As the result, the video signal output unit 11 outputs a signal to present the black image to the shift register 3 of the data line drive circuit 2, in the same manner as in video muting, thereby making the black display on all the pixels of the LCD and presenting to the user a state of the images erased.

This state is illustrated by the normal video signal 7 being cut at the fourth point of time t4, in FIG. 4(*b*), and the black image display signal 12 is outputted at this time. Here, in the LCD display unit that is not specially provided with the black image display function for video muting, the black image is to be displayed by preparing the output unit for the black image display signal 12, for the video signal output during the power being turned off.

Thereafter, the power operation timing controller 17 detects whether or not a specific time period T3, required for all the pixels of the liquid crystal module 1 to turn into a state of the black image display, has passed (step S13). After all the images turn into the state of the black image display, the video signal controller 24 outputs the video hold signal to the video-fixing signal output unit 15. The video-fixing signal output unit 15 then instructs the hold circuit 4 to maintain the signal of presenting the black image. The hold circuit 4 maintains the state thereafter (step S14). This state is illustrated as a state, in FIG. 4(*b*), that a video hold is executed at the fifth point of time t5 after the specific time period T3 passes from the fourth point of time t4, and the data line drive circuit 2 is prevented from outputting the video signal to each of the pixels.

In the power operation timing controller 17, the LCD supply voltage control unit 25 outputs a gate-off signal to the gate voltage control unit 21 at the same time as the foregoing point of time t5, and thereby the gate voltage control unit 21 turns off the power supply of the address line drive circuit 9 as the gate driver (step S15). This causes the disappearance of the gate voltages of the TFTs as the drive elements of the pixels to turn the TFTs off, which halts the operation in a state that each of the pixels is supplied with the storage voltage for the black image display of the storage capacitor.

After all the pixels turn into the black image display, the power operation timing controller 17 detects whether or not a specific time period T4 has passed (step S16). When the time period T4 has passed, the LCD supply voltage control unit 25 outputs an off-signal to the common electrode control unit 22, which turns into off the common electrodes having supplied the facing voltages to the video signal supply elements of the pixels (step S17). This state is illustrated as a state, in FIG. 4(*b*), that the common electrodes are turned into off at the sixth point of time t6 after the specific time T4 passes from the fifth point of time t5. In this manner, the common electrodes are turned off after the gate supply voltages are turned off, which makes it possible to maintain the black image display that the hold circuit 4 holds.

After the gate voltages are turned off at the fifth point of time t5, the charges stored across the pixels are discharged gradually in accordance with the time constant, which is determined by a resister R1 of the liquid crystal and a total capacitance C3 of a capacitor C1 that the liquid crystal has and a storage capacitance C2. The discharge continues after the common electrodes are turned off, depending on the circuit characteristics. The state of the voltage drop is illustrated by the pixel/capacitor voltage in FIG. 4(*b*), in which the voltage gradually drops from the initial pixel voltage Va for the black image display. In this manner, the pixel voltage sufficiently drops over the time period T4 after turning off the gate voltage; and at this point of time, if the common electrodes applying the facing voltages to the pixels are turned off, it will not give the pixels such large voltage variations as in the conventional LCD display, which maintains the black image display stably.

After the common electrodes are turned off, the power operation timing controller 17 detects whether or not a further time period T5 has passed (step S18). After a time period T5 passes, the LCD supply voltage control unit 25 outputs the off-signal to a source voltage control unit 20, and the source voltage control unit 20 turns off the operation power supply to the data line drive circuit 2 (step S19). The time period T5 is set to the seventh point of time t7 where the pixel voltage has sufficiently dropped, after the total time of T4 and T5 passes after the fifth point of time t5 where the gate voltage is turned off. That is, the pixel voltage at the seventh point of time t7 has dropped, according to the aforementioned discharge characteristics, from the voltage Va where the black image display is on to the voltage Vb or lower where the voltage at that time can hardly present the image and a sudden voltage fluctuation will not influence the displayed image accordingly. Thus, the power-off operation is terminated (step S20).

In the foregoing embodiment, the supply voltages to the common electrodes are turned off after the gate supply voltages are turned off; however in reverse, if the gate supply voltages are turned off after the supply voltages to the common electrodes are turned off, or if both are turned off at the same time, it will display the same effect. Further, in the embodiment, the black image display to carry out video muting is utilized, when the power-off signal is detected; however, it is also possible to provide a means that displays another specific image and maintains the specific image.

In the LCD display unit of the invention provided with the aforementioned power operation timing controller 17, the various operations of the power-on/off as described above can be carried out, and it is further possible to carry out the control in various modes, by operating the video switch 8, video signal output unit 11, video-fixing signal output unit 15, source voltage control unit 20, gate voltage control unit 21, common electrode control unit 22, and the like, in an arbitrary order and at an arbitrary points of time.

Since the invention is constructed as described above, when the power supply is shut off in the reflex type LCD that displays a video image mainly by reflected light, it is possible to prevent irregular after-images from being created on the LCD display.

In another embodiment, since the point of time to turn the common electrodes off is set to a point of time after maintaining the display of the specific image for a specific time, it is possible to securely maintain displaying the specific image after turning off the gate voltages.

In another embodiment, since the point of time to turn off the power supply to the data line drive circuit is set to a point of time when the common electrode voltage is almost dissipated, when the power supply to the data line drive circuit is turned off, the common electrode voltage is sufficiently lowered to prevent the irregular after-image phenomenon, if the power supply to the data line drive circuit is turned off.

Further, in another embodiment, the power operation timing controller is provided with a means that, when the power supply is turned on, after turning on the source voltage control unit, gate voltage control unit, and common electrode control unit, outputs the video signal to the data line drive circuit. Therefore, other than the foregoing power-off control, the function elements can be operated at appropriate timings also in the power-on operation. Specifically, after the source voltage control unit, gate voltage control unit, and common electrode control unit are turned on, the video signal is outputted to the data line drive circuit; and therefore, an initial unstable image display can be prevented.

What is claimed is:

1. An LCD display unit that displays video images principally by reflected light, comprising:

a video setting unit that sets either a normal video signal or a specific image display signal as a video signal for image display;

a gate voltage control unit that controls a gate voltage of drive elements of pixels;

a common electrode control unit that controls common electrodes of the pixels;

a source voltage control unit that controls a supply voltage to a data line drive circuit; and a power operation timing controller that controls operation timings of the units when a power-on signal or a power-off signal is detected, wherein, after the video setting unit sets the specific image display signal when a power-off signal is detected, the power operation timing controller causes the gate voltage control unit to turn off the gate voltage, the common electrode control unit to turn the common electrodes off, and next the source voltage control unit to turn off the supply voltage to the data line drive circuit, and wherein a point of time at which the common electrodes are turned off is set to a point of time after an image display by the specific image display signal is maintained for a specific time.

2. An LCD display unit as claimed in claim 1 wherein the specific image display signal is a black image display signal.

3. An LCD display unit as claimed in claim 1 wherein the video setting unit makes a specific switch execute a switching of the normal video signal and the specific image display signal.

4. An LCD display unit as claimed in claim 1 wherein a point of time at which the supply voltage to the data line drive circuit is turned off is set to a point of time at which a common electrode voltage is substantially dissipated.

5. An LCD display unit as claimed in claim 1, wherein, when a power-on signal is detected, the power operation timing controller outputs, after turning on the source voltage control unit, the gate voltage control unit, and the common electrode control unit, the video signal to the data line drive circuit.

6. An LCD display unit as claimed in claim 1, further comprising a video mute processor, wherein, when the video mute processor detects a video mute signal, the video setting unit executes a setting from the normal video signal into the specific image display signal.

7. An LCD display unit as claimed in claim 6, wherein the specific image display signal is a black image display signal.

8. An LCD display unit that displays video images principally by reflected light, comprising:

a video setting unit that sets either a normal video signal or a black image display signal as a video signal for image display;

a gate voltage control unit that controls a gate voltage of drive elements of pixels;

a common electrode control unit that controls common electrodes of the pixels;

a source voltage control unit that controls a supply voltage to a data line drive circuit;

a power on/off signal detector that detects a power-on signal or a power-off signal; and a power operation timing controller that controls operation timings of the units when the power on/off signal detector detects the power-on signal or the power-off signal, wherein, when the power on/off signal detector detects the power-off signal, the power operation timing controller, after the video setting unit sets the black image display signal, causes the gate voltage control unit to turn off the gate voltage, the common electrode control unit to turn the common electrodes off, and next the source voltage control unit to turn off the supply voltage to the data line drive circuit, and wherein a point of time at which the common electrodes are turned off is set to a point of time after a black image display caused by the black image display signal is maintained for a specific time.

9. An LCD display unit as claimed in claim 8, wherein a point of time at which supply voltage to the data line drive circuit is turned off is set to a point of time at which a common electrode voltage is substantially dissipated.

10. An LCD display unit as claimed in claim 8, wherein, when the power on/off signal detector detects the power-on signal, the power operation timing controller outputs, after turning on the source voltage control unit, the gate voltage control unit, and the common electrode control unit, the video signal to the data line drive circuit.

11. An LCD display unit as claimed in claim 8, further comprising a video mute processor, wherein, when the video mute processor detects a video mute signal, the video setting unit executes a setting from the normal video signal into the specific image display signal.

12. An LCD display unit as claimed in claim 11, wherein the specific image display signal is a black image display signal.

13. An LCD display method that displays video images principally by reflected light, the method comprising:

setting a specific image display signal from a normal video signal when a power-off signal is detected;

turning off a gate voltage by a gate voltage control unit, and turning common electrodes off by a common electrode control unit; and turning off a supply voltage to a data line drive circuit by a source voltage control unit, wherein a point of time at which the common electrodes are turned off is set to a point of time after an image display caused by the specific image display signal is maintained for a specific time.

14. An LCD display method as claimed in claim 13, wherein the specific image display signal is a black image display signal.

15. An LCD display unit as claimed in claim 13, wherein a point of time at which the supply voltage to the data line drive circuit is turned off is set to a point of time at which a common electrode voltage is substantially dissipated.

16. An LCD display method as claimed in claim 13, wherein, when a power-on signal is detected, after turning on the source voltage control unit, the gate voltage control unit, and the common electrode control unit, the video signal is outputted to the data line drive circuit.

17. An LCD display method as claimed in claim 13, wherein, when a video mute processor detects a video mute signal, a setting is executed from the normal video signal into the specific image display signal.

* * * * *